US009233741B2

(12) United States Patent
Lee

(10) Patent No.: US 9,233,741 B2
(45) Date of Patent: Jan. 12, 2016

(54) LIFE SAVING DAN BUOY

(71) Applicant: William Lee, Taipei (TW)

(72) Inventor: William Lee, Taipei (TW)

( * ) Notice: Subject to any disclaimer, the term of this patent is extended or adjusted under 35 U.S.C. 154(b) by 0 days.

(21) Appl. No.: 14/082,605

(22) Filed: Nov. 18, 2013

(65) Prior Publication Data

US 2015/0140879 A1 May 21, 2015

(51) Int. Cl.

| | |
|---|---|
| ***B63C 9/26*** | (2006.01) |
| ***B63C 9/20*** | (2006.01) |
| *B63C 9/08* | (2006.01) |

(52) U.S. Cl.

CPC . *B63C 9/26* (2013.01); *B63C 9/082* (2013.01); *B63C 9/20* (2013.01); *B63C 2009/085* (2013.01)

(58) Field of Classification Search

USPC ..... 441/84, 89
IPC ..... B63C 9/20,9/26
See application file for complete search history.

(56) References Cited

U.S. PATENT DOCUMENTS

| | | | | |
|---|---|---|---|---|
| 2,368,558 | A * | 1/1945 | Maloney | 441/84 |
| 4,498,879 | A | 2/1985 | Burr | |
| 5,257,954 | A | 11/1993 | Mullisen et al. | |
| 6,162,106 | A | 12/2000 | Shieh | |
| 7,927,162 | B1 * | 4/2011 | Doubleday | 441/89 |
| 2012/0178319 | A1 * | 7/2012 | Spencer | 441/89 |

OTHER PUBLICATIONS www.danbuoy.com, Oct. 2012.*

* cited by examiner

*Primary Examiner* — Stephen Avila
(74) *Attorney, Agent, or Firm* — Muncy, Geissler, Olds & Lowe, P.C.

(57) ABSTRACT

A life saving dan buoy for marine saving is revealed. The life saving dan buoy includes a strip-shaped first air bag, a second air bag disposed on a lower part of the first air bag, at least one inflation valve arranged at the first air bag and/or the second air bag for filling gas into an air chamber and allowing the first and the second air bags to expand and float over the water, and a weight. The first air bag and the second air are communicating with each other to form the air chamber. The second air bag includes an open space area that allows a user's body to get through. The weight is connected to a lower part of the first air bag so that the first air bag is standing vertically in the sea while the second air bag is floated over the sea.

18 Claims, 9 Drawing Sheets

LIFE SAVING DAN BUOY

BACKGROUND OF THE INVENTION

The present invention relates to a marine life saving equipment, especially to a life saving dan buoy that is used as a buoyancy aid for providing buoyancy to a user in the water.

Life saving equipment generally disposed on a ship includes lifeboats and life rings that allow for emergency escape. Once in time-critical emergencies, life rings are more efficient than lifeboats. Thus life rings are still one of the most common used equipment for protecting lives at sea. Although people falling into the water are easy to get the life rings and float over the sea, it is difficult to see people with life rings in the large ocean under bad weather. And people are easy to be out of sight of rescuers in bad weather. Once people in water are not easy to grip the life rings or rescuers are unable to find out people in water in time, survival rate of people in water is dramatically reduced.

Thus besides good buoyancy for the person in water, practical parking of a location is also important for marine life saving equipment. Thereby the chance of rescue and the survival rate of people in the sea are increased.

Refer to U.S. Pat. App. No. 20120178319, a marine safety device is revealed. The shortcoming of the marine safety device is in that an inflatable member is unable to support the person in the water and a grippable member is required for the person to hold. Thus the physical strength of the person is lost. At the same time, the mast is immersed into the water so that the marking of the location is getting unclear. Thus the person in the water is in a more dangerous situation. The search and rescue are more difficult.

Refer to U.S. Pat. Nos. 4,498,879, and 5,257,954, an emergency rescue device and a rescue buoy package are disclosed. The disadvantage of these devices is in that a life buoy and a dan buoy are separated from each other and connected by a rope/line. The structure is complicated so that many components are required. Moreover, the person in the wall may get strangled by lines. Thus the rescue devices are not safe.

Refer to U.S. Pat. No. 6,162,106, an inflatable flag buoy for divers is revealed. The inflatable flag buoy includes an air chamber being filled with air to produce buoyancy for keeping the flag buoy afloat. The inflatable flag buoy is also used to mark positions for divers, not an emergency rescue device. Once the inflatable flag buoy is used in rescue operation, person in the water can only hold the cord outside lug pieces. When bad weather strikes, the person in the water is getting weaker during the period he is waiting for rescue due to lack of physical strength.

SUMMARY OF THE INVENTION

The present invention relates to a life saving dan buoy that overcomes shortcomings of conventional equipment, having compact and simple structure, and provides good marking of positions. Moreover, the life saving dan buoy is used as a more stable and safe buoyancy aid that provides support to a person in the water for keeping the physical strength and waiting for rescue.

In order to achieve the above object, a life saving dan buoy for marine life saving of the present invention includes a first air bag, a second air bag, at least one inflation valve and a heavy. The first air bag is strip-shaped while the second air bag is set on a lower part of the first air bag and the first air bag is located at a middle part of the second air bag. The first air bag and the second air are communicating with each other to form an air chamber for being filled with air. The second air bag includes an open space area that allows a user's body to get through. The inflation valve is disposed on the first air bag and/or the second air bag for filling gas into the air chamber so that the first and the second air bags are inflated to float over the water. The weight is disposed at a lower part of the first air bag and is maintained under sea surface so that the first air bag is standing vertically in the sea and the second air bag is floating over the sea.

While in use, the person in the water gets the second air bag around his body and support the body. At the moment, the first air bag is still standing in the water, without inclined and immersed into the water. Thus the life saving dan buoy works as a buoyancy aid and provides optimal buoyancy.

DETAILED DESCRIPTION OF THE PREFFERED EMBODIMENT

Figure 1:
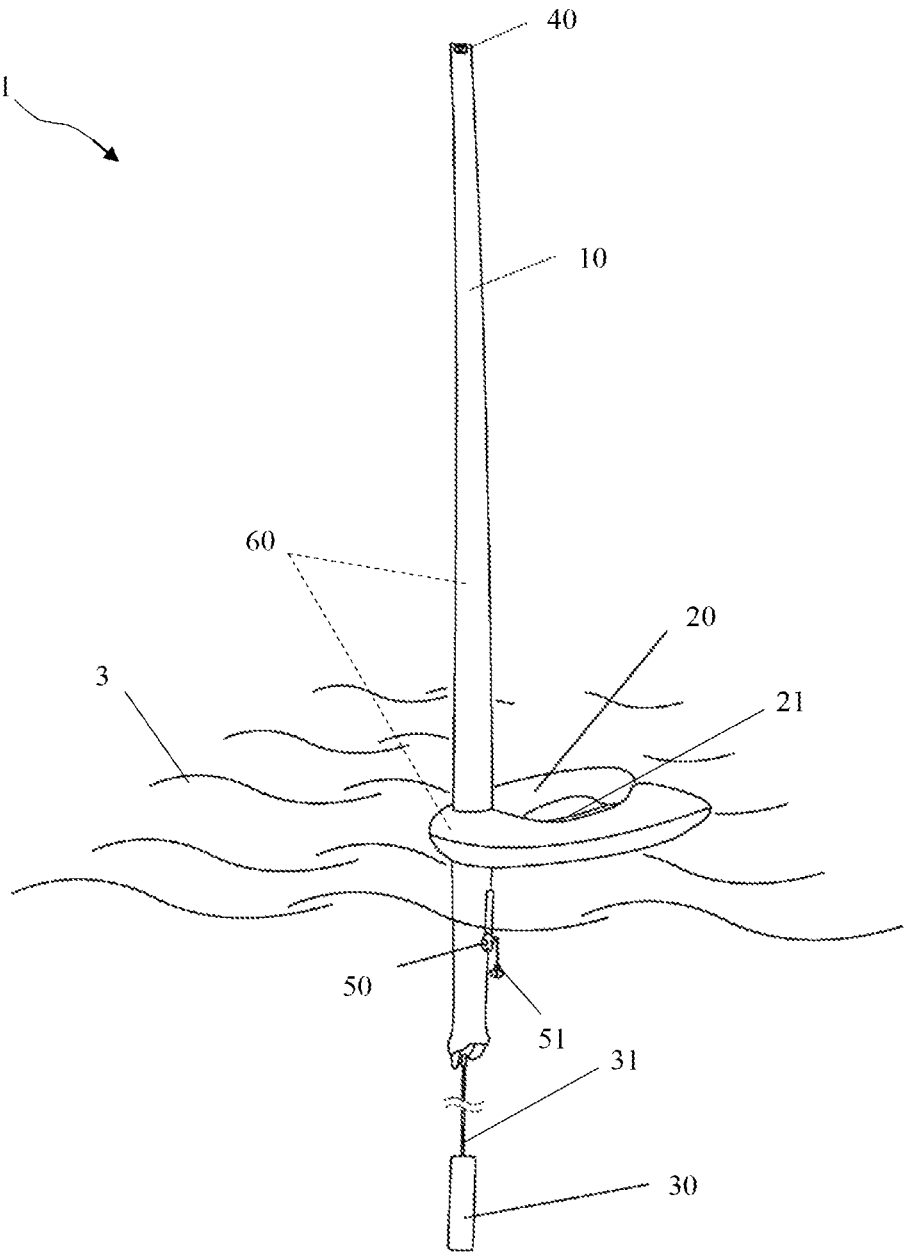
FIG. 1 is a perspective view of an embodiment of a life saving dan buoy in water after inflation according to the present invention.

Refer from FIG. 1 to FIG. 4, a life saving dan buoy 1 of the present invention includes a first air bag 10, a second air bag 20, a weight 30, a life light 40 and at least one inflation valve 50.

The first air bag 10 is a strip-shaped air bag.

The second air bag 20 is C-shaped, horseshoe shaped or circular. The second air bag 20 is disposed on a lower part of the first air bag 10 while the first air bag 10 is located at the middle part of the second air bag 20. The second air bag 20 and the first air bag 10 are communicating with each other so as to form an air chamber 60 for being filled with air. When air enters the air chamber 60, the first air bag 10 and the second air bag 20 are inflated to so as to make the life saving dan buoy 1 float over the water. An open space area 21 is arranged at a center of the second air bag 20 and is used for allowing a user's 2 body to get through. Thus the second air bag 20 is around the user's body and under the user's shoulders.

Figure 2:
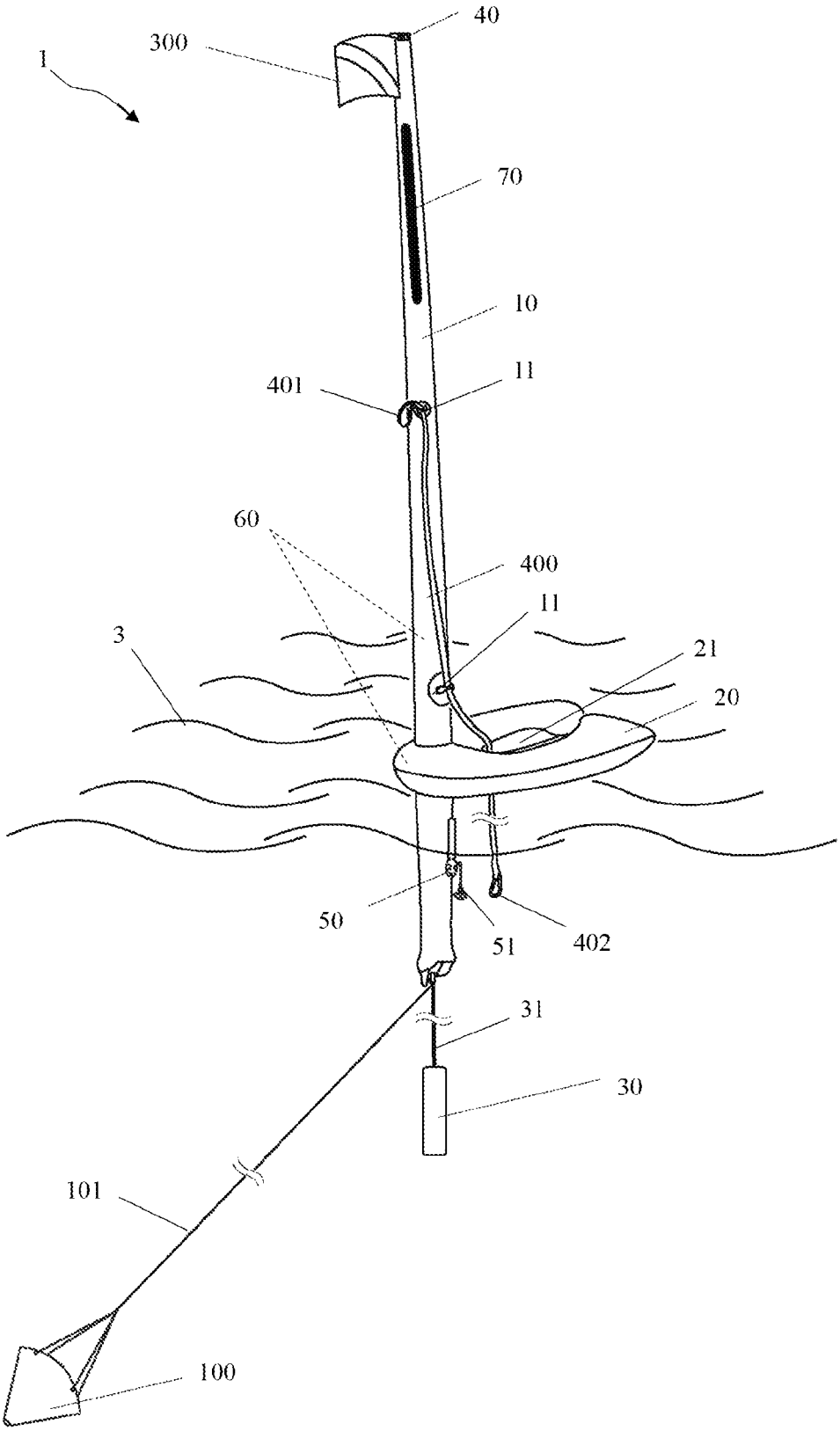
FIG. 2 is a perspective view of another embodiment of a life saving dan buoy in water after inflation according to the present invention.

The weight 30 is disposed at a lower part of the first air bag 10. By the weight 30, the lower part of the first air bag 10 is maintained under the sea surface 3, the first air bag 10 is standing vertically in the water, and the second air bag 20 is floated over the sea surface 3. As shown in FIG. 1 and FIG. 2, the weight 30 is connected to the bottom of the first air bag 10 by a rope 31. Moreover, a space (not shown in figure) can be designed in the bottom of the first air bag 10 and used for receiving the weight 30.

The life light 40 is set on an upper part of the first air bag 10. The life light 40 that emits light is used as a light spot for marking the position in the dark/at night.

The inflation valve 50 is arranged at the first air bag 10 and/or the second air bag 20 for filling gas into the air chamber 60. Thus the first air bag 10 and the second air bag 20 are inflated to float over the water. The inflation valve 50 further includes a pull rope 51. The user 2 pulls the pull rope 51 to activate the inflation of the inflation valve 50. The inflation valve 50 can be operated manually or automatically. The automatic inflation valve 50 is a kind of inflation valve 50 that is activated to inflate automatically when the inflation valve 50 comes in contact with the water.

The surface of the first air bag 10 is further installed with a reflection area 70 used to reflect light or radar waves for convenience of search and rescue. Moreover, the surface of the second air bag 20 can also be arranged with a reflection area (not shown in figure) that reflects light or radar waves.

Figure 2A:
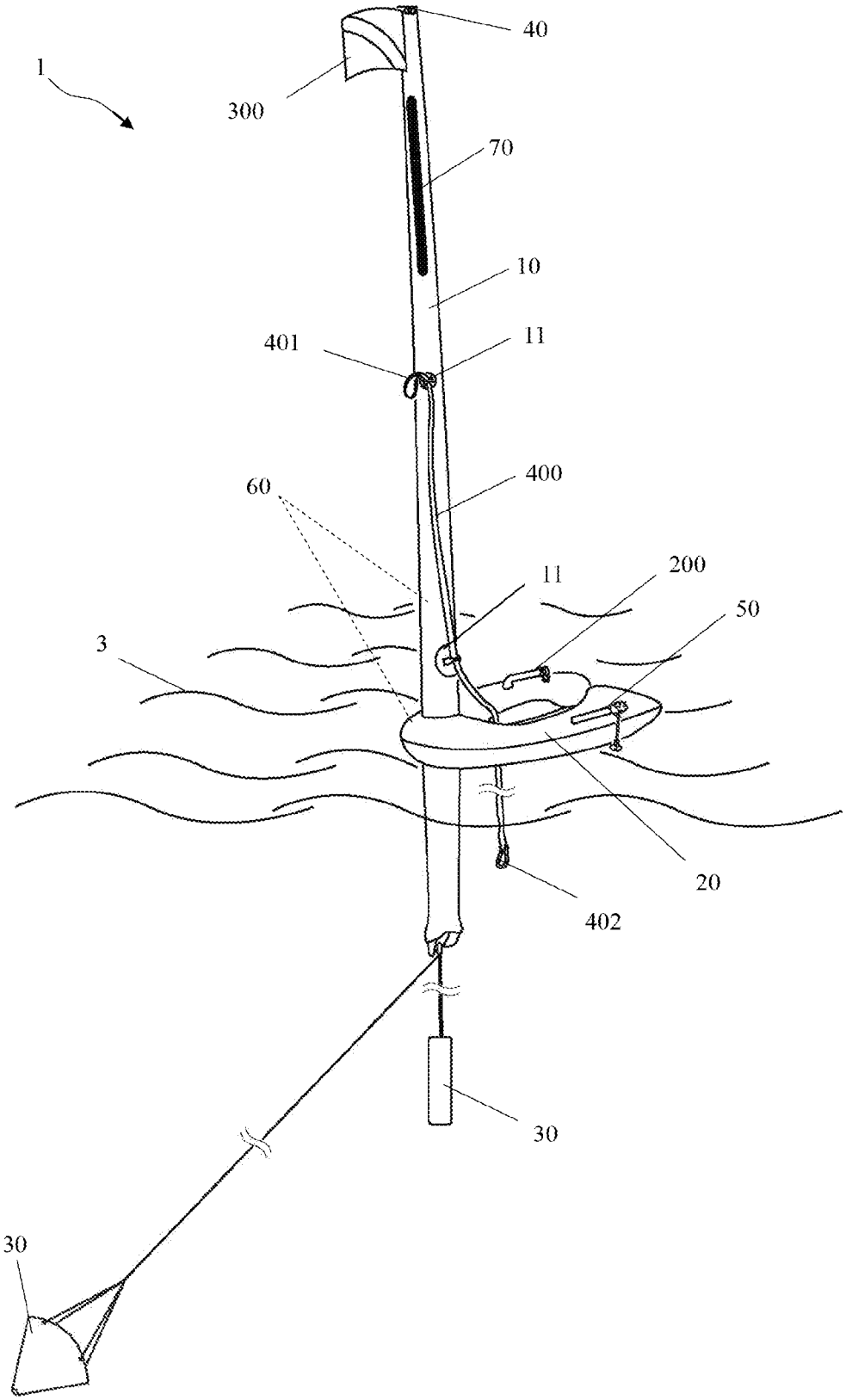
FIG. 2A is a perspective view of a further embodiment of a life saving dan buoy in water after inflation according to the present invention.
Figure 3:
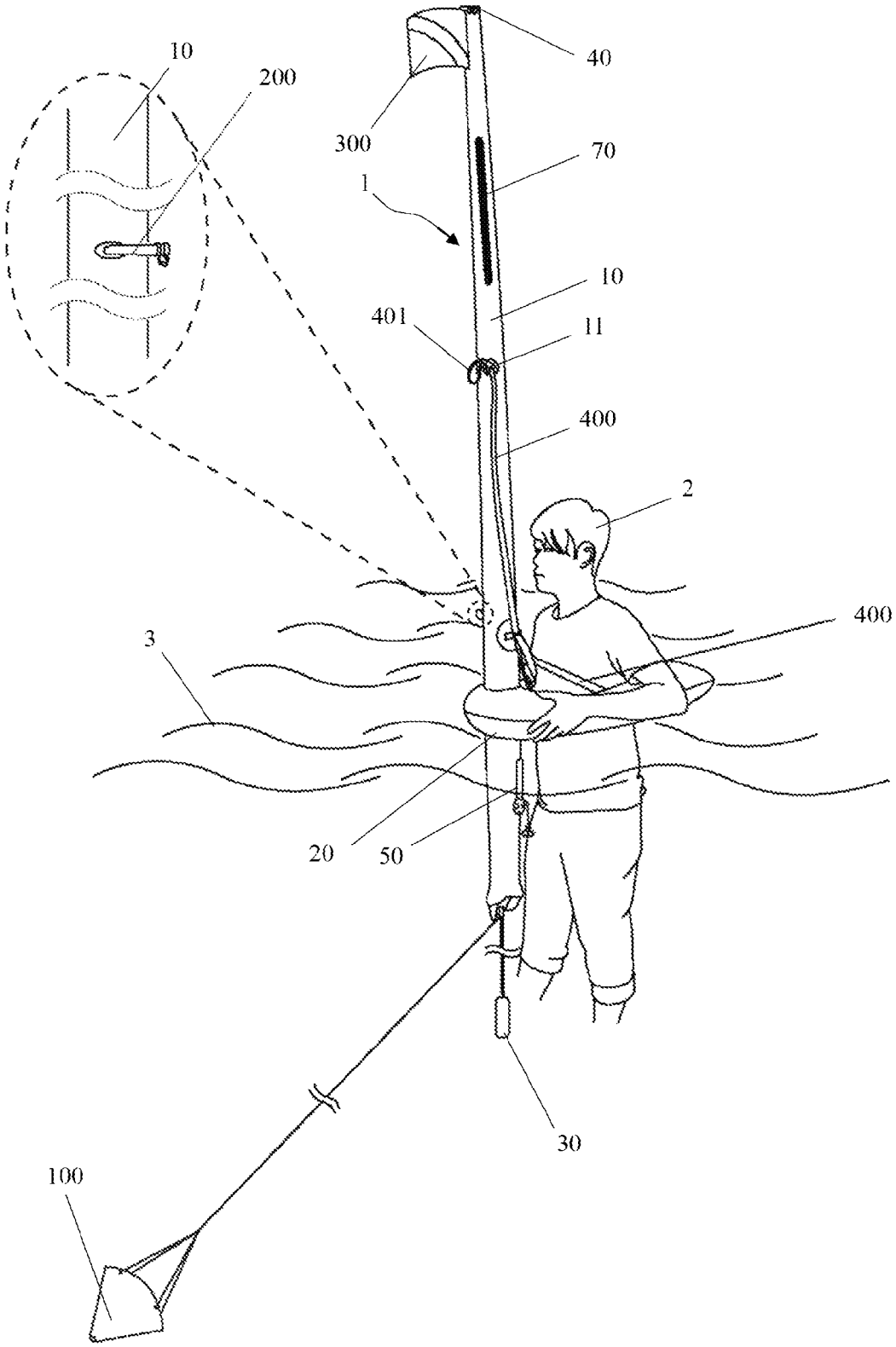
FIG. 3 is a schematic drawing showing that a person in water gets the embodiment in FIG. 2 around his body according to the present invention.

Refer to FIG. 2 and FIG. 2A, the life saving dan buoy 1 of the present invention further includes a sea anchor 100, at least one oral inflator 200, a flap 300 and at least one webbing 400.

The sea anchor 100 is connected to a lower part of the first air bag 10 by another rope 101 to provide a resistance and reduce drift rate of both the first air bag 10 and the second air bag 20 over the sea.

The oral inflator 200 is disposed on the first air bag 10 and/or the second air bag 20 for the user 2 to refill the air chamber 60.

The flap 300 is arranged at an upper part of the first air bag 10 for better position marking. Moreover, the flap 300 can also be used to find wind direction.

Figure 4:
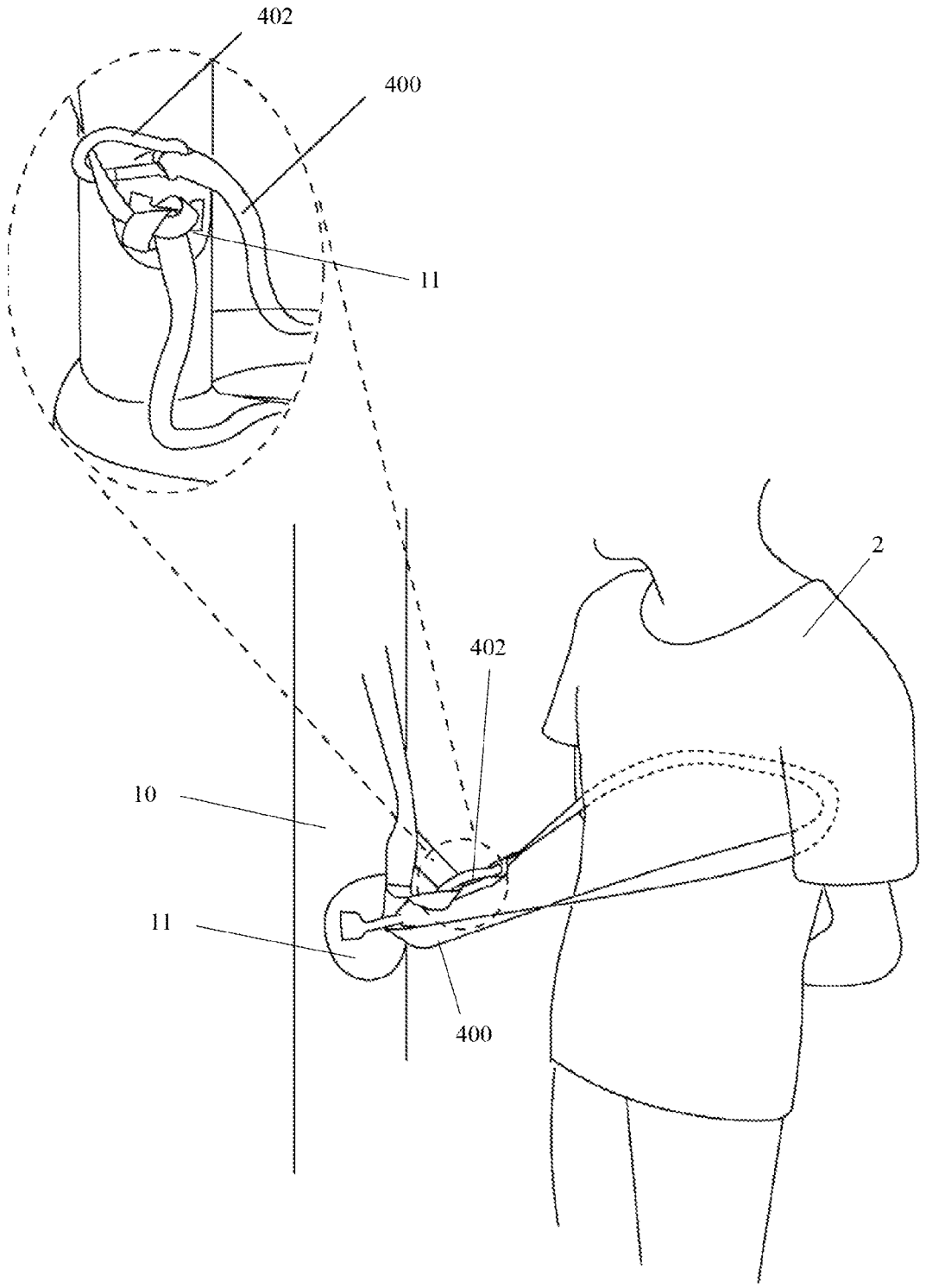
FIG. 4 is a schematic drawing showing connection between a user and a webbing of an embodiment according to the present invention.

The webbing 400 is arranged along the length direction of the first air bag 10. A plurality of connecting parts 11 is disposed vertically with a certain interval on the first air bag 10 along the length direction of the first air bag 10. The connecting parts 11 are used to connect with the webbing 400 so as to keep the webbing 400 on the first air bag 10. One end of the webbing 400 is extended upward toward the upper part of the first air bag 10 and at least one webbing loop 401 is disposed thereof for being griped and pulled by the rescuer's hand. The other end of the webbing 400 is extended downward toward the lower part of the first air bag 10 and a hook 402 is arranged thereof. The bottom end of the webbing 400 is wound around the user's body and then the hook 402 is fastened on the webbing 400, as shown in FIG. 4. Thus the webbing 400 is used as a safety belt to ensure that the connection between the life saving dan buoy 1 and the user 2 is tight and safe. Moreover, the hook 402 can also be connected to other life saving equipment (not shown in figure) available on the user's body so as to increase the safety of the life saving equipment. Due to the arrangement of the webbing loop 401, the rescuer can pull the user 2 together with the life saving dan buoy 1 from the sea by the webbing loop 401. Thus the rescue operation is simple, easy, fast and safe.

Figure 5:
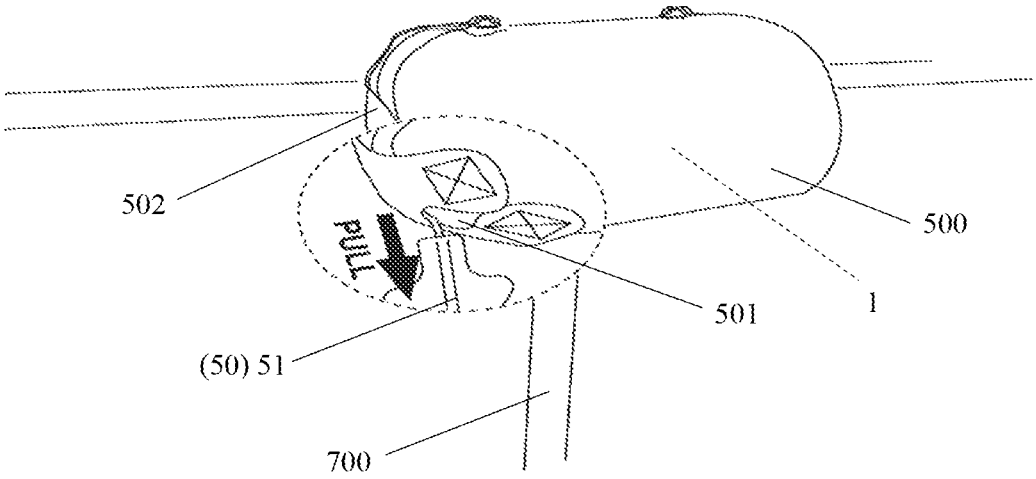
FIG. 5 is a perspective view of an embodiment mounted in an outer bag according to the present invention.

As shown in FIG. 5, the life saving dan buoy 1 is mounted in a outer bag 500 with an opening 501. The pull rope 51 of the inflation valve 50 is extended from the opening 501 to be exposed outside the outer bag 500. A fastener 502 is disposed on a part of the opening 501. In a close state, the fastener 502 looks like a zipper in a closed position. When the life saving dan buoy 1 is mounted in the outer bag 500 is inflated and expanded to against the outer bag 500, the fastener 502 is opened automatically so as to release the life saving dan buoy 1 from the outer bag 500.

Figure 6:
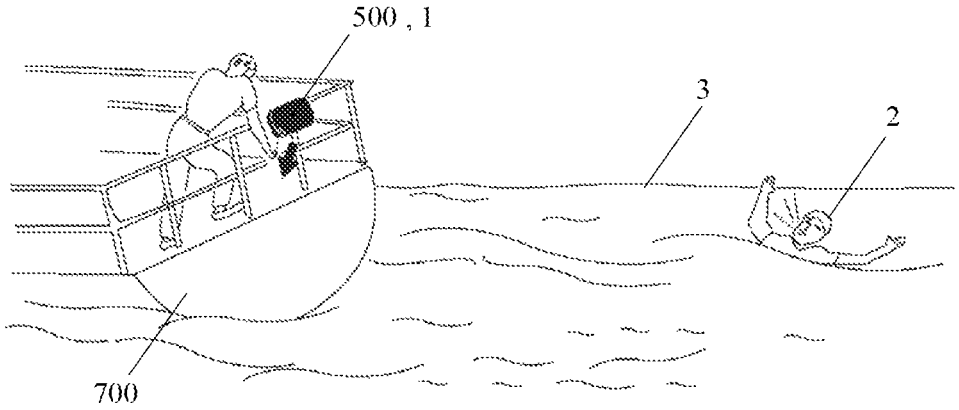
FIG. 6 and FIG. 7 are schematic drawings showing an embodiment with a manual inflation valve in use according to the present invention.
Figure 7:
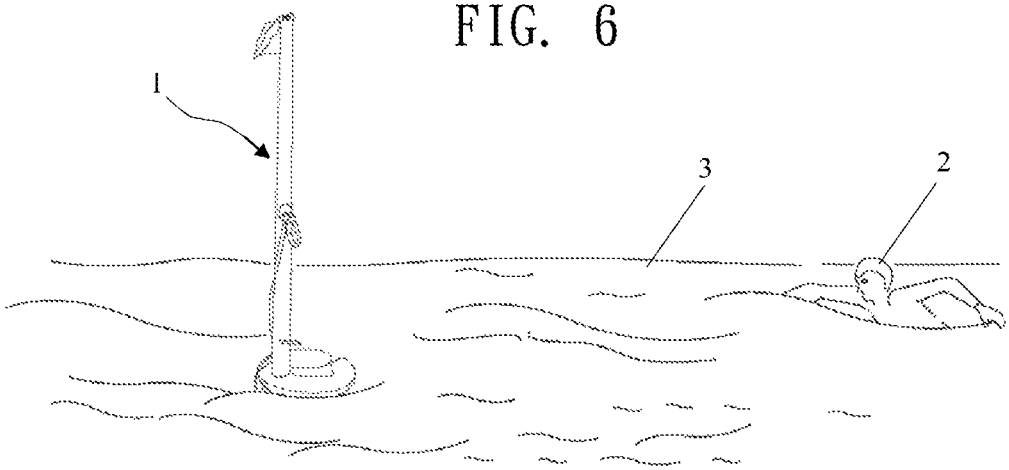

Refer to FIG. 6 and FIG. 7, take a manually-operated inflation valve 50 as an example. While in use, the outer bag 500 is fixed on a ship 700. The pull rope 51 of the inflation valve 50 is pulled so that air is filled into the air chamber 60 of the life saving dan buoy 1. Thus the first air bag 10 and the second air bag 20 are inflated. Then the fastener 502 on the opening 501 of the outer bag 500 is opened due to the expanded first air bag 10 and the second air bag 20. Finally, the inflation is completed and the life saving dan buoy 1 is falling into the sea for life saving.

Figure 8:
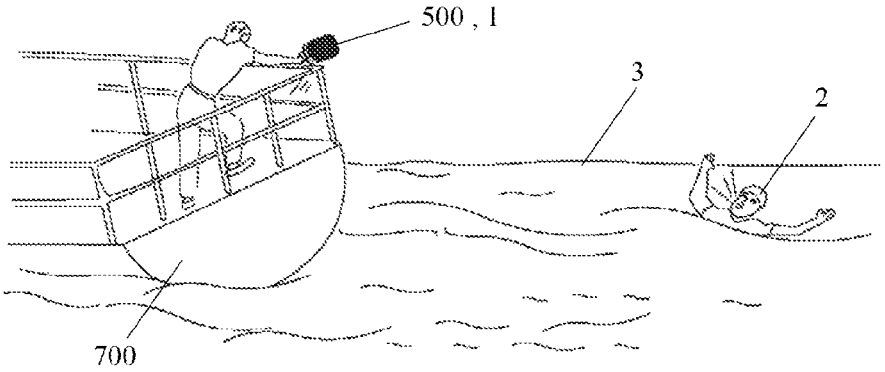
FIG. 8 and FIG. 9 are schematic drawings showing an embodiment with an automatic inflation valve in use according to the present invention.
Figure 9:
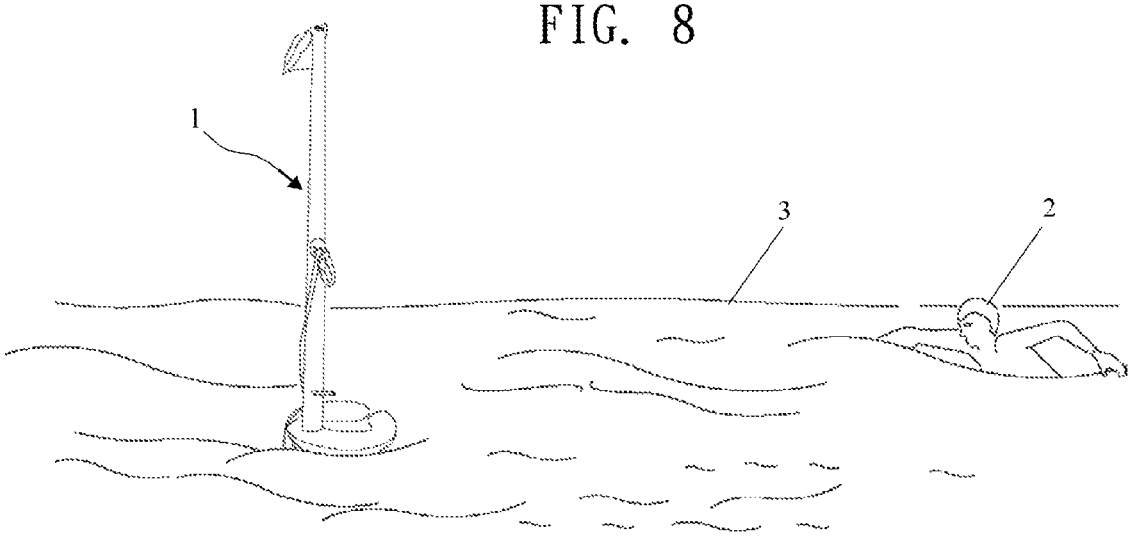

Refer to FIG. 8 and FIG. 9, take an automatically-operated inflation valve 50 as an example. While in use, the outer bag 500 is thrown into the person in the water (the user 2). Once the inflation valve 50 of the life saving dan buoy 1 is in contact with water, the air chamber 60 of the life saving dan buoy 1 is refilled with gas and the first air bag 10 as well as the second air bag 20 is inflated and expanded. Then the fastener 502 on the opening 501 of the outer bag 500 is opened due to the expanded first air bag 10 and the second air bag 20. Finally, the inflation is completed and the life saving dan buoy 1 is used for marine life saving.

Figure 10:
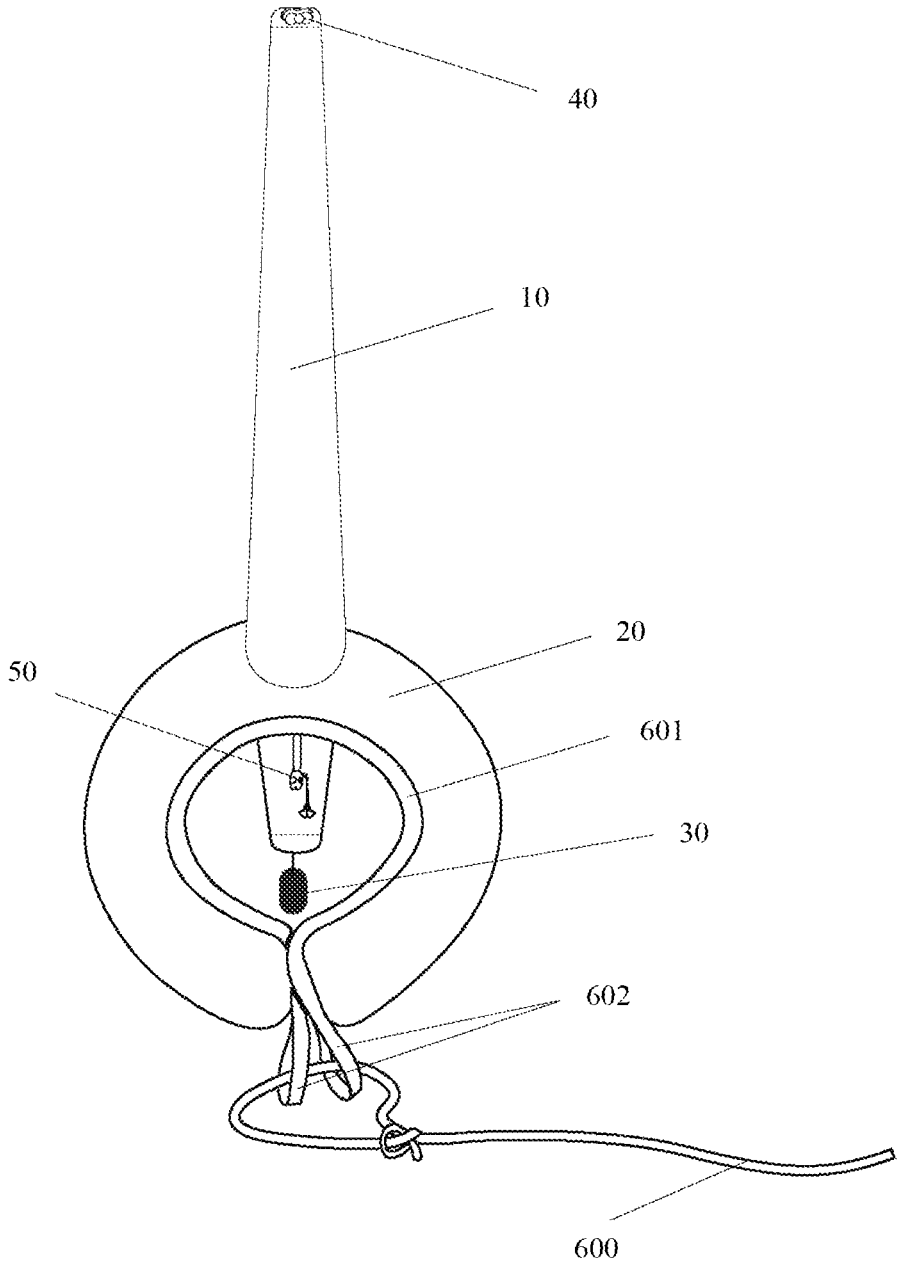
FIG. 10 is a schematic drawing showing a top view of an embodiment according to the present invention.
Figure 11:
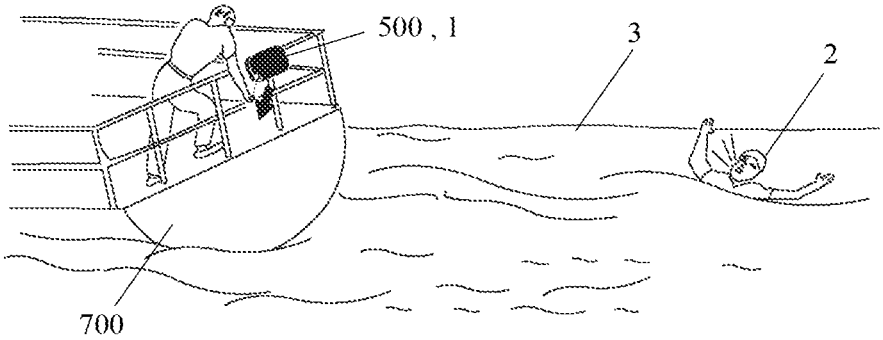
FIG. 11 to FIG. 13 are schematic drawings showing the embodiment in FIG. 10 in use according to the present invention.
Figure 12:
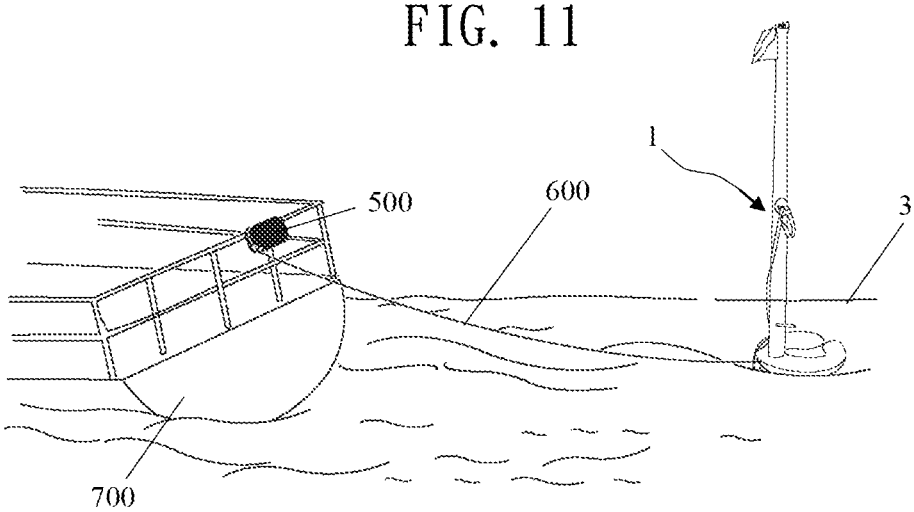
Figure 13:
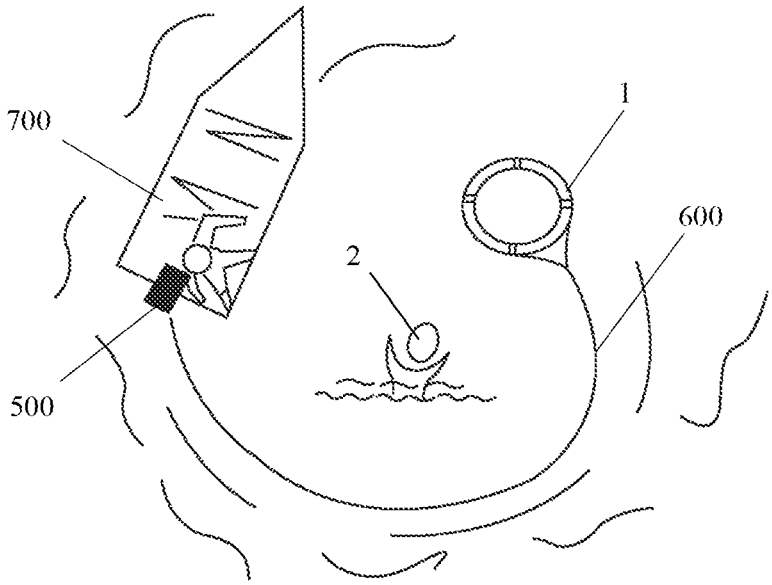

Refer to FIG. 10 to FIG. 13, the life saving dan buoy 1 of the present invention further includes a long rope 600. One end of the long rope 600 is connected to the second air bag 20 while the other end of the long rope 600 is connected to the ship 700, or to the outer bag 500 and then is fixed on the ship 700 through the outer bag 500. For example, as shown in FIG. 11 to FIG. 13, first the life saving dan buoy is inflated, expanded and falling into the sea automatically. Then the rescuer can drive the ship 700 and use the long rope 600 to drag the life saving dan buoy 1 moving around and approaching the person in the water (the user 2). Thus the person in the water (the user 2) is easier to get/grab the life saving dan buoy 1. When the person in the water (the user 2) gets the second air bag 2 around his body, he is pulled back to the ship 700 by the long rope 600. As shown in FIG. 10, a connecting rope 601 is disposed around an inner side surface of the second air bag 20. A rope loop 602 is disposed on each of two ends of the connecting rope 601 that are extended from the second air bag 20. One end of the long rope 600 is passed through the two rope loops 602 so as to connect to the second air bag 20. The structural strength of the second air bag 20 is improved due to the disposition of the connecting rope 601. Moreover, while the life saving dan buoy 1 is dragged by the long rope 600, the second air bag 20 is getting closer to or even tightening the user's 2 body to ensure the safety-in-use.

According to the structure of the life saving dan buoy 1, the user 2 is supported by the second air bag 20 around the user's 2 body so as to float stably and safely over the sea. Compared with the conventional technique mentioned above, the assembly of the first air bag 10 and the second air bag 20 of the present invention can reduce the influence of ocean waves and the related disasters.

After being tested and used, it is found that the first air bag 10 of the life saving dan buoy 1 according to the present invention is standing vertically in the sea. As to the conventional dan buoy, the mast is gripped tightly by the person in water and is inclined downward due to person's weight. Thus the person is sinking more deeply in the water. Compared with the conventional dan buoy, life saving dan buoy 1 of the present invention provides both the first air bag 10 and the second air bag 20 as buoyancy aids. Not only a life ring or a mast is used as a buoyancy aid. Thus the life saving dan buoy 1 of the present invention is with higher safety.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A life saving dan buoy for marine life saving comprising:

a first air bag that is a strip-shaped air bag;

a second air bag that is disposed on a lower part of the first air bag while the first air bag is located at the middle part of the second air bag; the first air bag and the second air bag are communicating with each other to form an air chamber for being filled with air; the second air bag includes an open space area allowing a user's body to get through;

at least one inflation valve that is arranged at the first air bag and/or the second air bag for filling gas into the air chamber so that the first air bag and the second air bag are inflated;

a weight that is disposed at a lower part of the first air bag and is maintained under sea surface so as to make the first air bag stand vertically in the sea and keep the second air bag over the sea; and at least one webbing that is arranged along a length direction of the first air bag; a plurality of connecting parts is disposed vertically with a certain interval on the first air bag along the length direction of the first air bag and the connecting parts are connected to the webbing to keep the webbing on the first air bag, wherein one end of the webbing is extended upward toward an upper part of the first air bag and is disposed with at least one webbing loop for being gripped and pulled by a rescuer's hand; the other end of the webbing is extended downward toward a lower art of the first air bag and is arranged with a hook; the hook is fastened on the webbing after the webbing being wound around user's body.

2. The device as claimed in claim 1, wherein the life saving dan buoy further includes a sea anchor that is connected to a lower part of the first air bag by a rope so as to reduce drift rate of both the first air bag and the second air bag over the sea.

3. The device as claimed in claim 1, wherein the life saving dan buoy further includes an oral inflator disposed on the first air bag and/or the second air bag.

4. The device as claimed in claim 1, wherein the life saving dan buoy further includes a flap and a life light, both set on an upper part of the first air bag.

5. The device as claimed in claim 1, wherein the second air bag is C-shaped, horseshoe shaped or circular.

6. The device as claimed in claim 1, wherein a surface of the first air bag is arranged with a reflection area used for reflecting light or radar waves.

7. The device as claimed in claim 1, wherein the life saving dan buoy is mounted in an outer bag with an opening; a fastener is disposed on a part of the opening; the fastener is opened automatically when the life saving dan buoy in the outer bag is inflated and expanded to against the outer bag.

8. The device as claimed in claim 7, wherein the second air bag of the life dan buoy is connected to one end of a long rope while the other end of the long rope is connected to a ship, or to the outer bag and then is fixed on the ship through the outer bag.

9. The device as claimed in claim 8, wherein a connecting rope is disposed around an inner side surface of the second air bag; a rope loop is disposed on each of two ends of the connecting rope that are extended from the second air bag; one end of the long rope is passed through the two rope loops so as to connect to the second air bag.

10. A life saving dan buoy for marine life saving comprising:

a first air bag that is a strip-shaped air bag;

a second air bag that is disposed on a lower part of the first air bag while the first air bag is located at the middle part of the second air bag; the first air bag and the second air bag are communicating with each other to form an air chamber for being filled with air; the second air bag includes an open space area allowing a user's body to get through;

at least one inflation valve that is arranged at the first air bag and/or the second air bag for filling gas into the air chamber so that the first air bag and the second air bag are inflated; and a weight that is disposed at a lower part of the first air bag and is maintained under sea surface so as to make the first air bag stand vertically in the sea and keep the second air bag over the sea;

wherein the second air bag of the life dan buoy is connected to one end of a long rope while the other end of the long rope is connected to a ship, or to the outer bag and then is fixed on the ship through the outer bag, and wherein a connecting rope is disposed around an inner side surface of the second air bag; a rope loop is disposed on each of two ends of the connecting rope that are extended from the second air bag; one end of the long rope is passed through the two rope loops so as to connect to the second air bag.

11. The device as claimed in claim 10, wherein the life saving dan buoy further includes a sea anchor that is connected to a lower part of the first air bag by a rope so as to reduce drift rate of both the first air bag and the second air bag over the sea.

12. The device as claimed in claim 10, wherein the life saving dan buoy further includes an oral inflator disposed on the first air bag and/or the second air bag.

13. The device as claimed in claim 10, wherein the life saving dan buoy further includes a flap and a life light, both set on an upper part of the first air bag.

14. The device as claimed in claim 10, wherein the life saving dan buoy further includes at least one webbing that is arranged along a length direction of the first air bag; a plurality of connecting parts is disposed vertically with a certain interval on the first air bag along the length direction of the first air bag and the connecting parts are connected to the webbing to keep the webbing on the first air bag.

15. The device as claimed in claim 14, wherein one end of the webbing is extended upward toward an upper part of the first air bag and is disposed with at least one webbing loop for being gripped and pulled by a rescuer's hand; the other end of the webbing is extended downward toward a lower part of the first air bag and is arranged with a hook; the hook is fastened on the webbing after the webbing being wound around user's body.

16. The device as claimed in claim 10, wherein the second air bag is C-shaped, horseshoe shaped or circular.

17. The device as claimed in claim 10, wherein a surface of the first air bag is arranged with a reflection area used for reflecting light or radar waves.

18. The device as claimed in claim 10, wherein the life saving dan buoy is mounted in an outer bag with an opening;

a fastener is disposed on a part of the opening; the fastener is opened automatically when the life saving dan buoy in the outer bag is inflated and expanded to against the outer bag.

* * * * *